US009637889B2

(12) United States Patent
Elkins

(10) Patent No.: US 9,637,889 B2
(45) Date of Patent: May 2, 2017

(54) AUTOMATED MOLDBOARD DRAFT CONTROL SYSTEM AND METHOD

(71) Applicant: CNH Industrial America LLC, New Holland, PA (US)

(72) Inventor: Scott A. Elkins, Plainfield, IL (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 14/738,450

(22) Filed: Jun. 12, 2015

(65) Prior Publication Data

US 2016/0362870 A1 Dec. 15, 2016

(51) Int. Cl.

| | |
|---|---|
| ***E02F 3/84*** | (2006.01) |
| ***E02F 3/76*** | (2006.01) |
| ***E02F 9/26*** | (2006.01) |

(52) U.S. Cl.

CPC ..... *E02F 3/844* (2013.01); *E02F 3/765* (2013.01); *E02F 9/264* (2013.01)

(58) Field of Classification Search

CPC .. B60G 17/00; B60G 2200/46; B60N 2/4633; B60N 2/4693; E02F 9/2004; E02F 3/7645; E02F 3/765; E02F 3/7654; E02F 9/225; E02F 9/2296; E02F 3/844; E02F 3/845; E02F 3/847; E02F 3/848; E02F 3/84; E02F 9/205; E02F 3/865; E02F 9/264; G05B 19/409; G05B 2219/36159; G05B 2219/36542; G05B 2219/45012; G07C 5/008; G07C 5/12; G05G 9/047; G05G 9/04788

USPC ..... 172/2–11; 37/348; 701/42, 50

See application file for complete search history.

(56) References Cited

U.S. PATENT DOCUMENTS

| | | | | |
|---|---|---|---|---|
| 3,527,315 | A | 9/1970 | Hampton | |
| H001831 | H | 2/2000 | Kelley et al. | |
| 6,152,239 | A | 11/2000 | Kelley et al. | |
| 8,060,299 | B2 | 11/2011 | Gharsalli et al. | |
| 8,412,420 | B2 | 4/2013 | Ruhter et al. | |
| 8,746,395 | B2 | 6/2014 | Frazier et al. | |
| 9,213,331 | B2 * | 12/2015 | Johnson | G05B 19/409 |
| 9,227,478 | B2 * | 1/2016 | Horstman | B60G 17/00 |
| 2012/0160526 | A1 | 6/2012 | Padilla | |
| 2013/0180744 | A1 | 7/2013 | Favreau et al. | |

* cited by examiner

*Primary Examiner* — Robert Pezzuto
(74) *Attorney, Agent, or Firm* — Patrick M. Sheldrake

(57) ABSTRACT

A motor grader having a moldboard and tiltable wheels is provided with a sensor system and electronic controller for determining a required wheel tilt to overcome anticipated draft forces resulting from the angle to which the moldboard is adjusted. The wheels are automatically leaned as determined necessary for counteracting the draft forces. An all-wheel-drive system can be controlled together with wheel lean for counteracting draft forces. Inputs from moldboard tilt and roll, motor grader positioning and orientation and the like can be included in determining anticipated draft forces.

17 Claims, 4 Drawing Sheets

AUTOMATED MOLDBOARD DRAFT CONTROL SYSTEM AND METHOD

BACKGROUND OF THE INVENTION

1. Field of the Invention

The present invention relates to motor graders, and, more particularly, to control systems and the operation of motor graders to overcome draft.

2. Description of the Related Art

Motor graders, also known as "road graders", are used in many aspects of road construction and maintenance, as well as for material moving and finish grading for general purposes. Motor graders can be used to shape the ground for general purposes, such as developing ditches, and for shaping the final surface of a roadbed. In maintenance operations, motor graders can be used, for example, to clean and reform ditches, to reshape and contour worn road beds, to spread added material on a roadbed, to remove snow and the like. To achieve such versatility in operation, motor graders are highly controllable with respect to the set up and operation thereof.

A motor grader can include an articulating frame having a rear frame portion carrying a motor, transmission, operator cab and the like, and an elongated front frame portion that includes adjustable front wheels and an earth scraping blade which commonly is referred to as a moldboard. Carrying and adjustment structure for the moldboard allows adjustments for angle, tilt and roll of the moldboard as well as lateral side shifting.

Manual controls or input devices are provided for various operating and adjustment aspects, such as steering, speed, moldboard positioning, frame articulation, wheel angle orientation and power input.

To achieve a desired earth shaping result, the operator of a motor grader has many adjustments available, including moldboard elevation and extension, moldboard angle relative to the frame axis, moldboard tilt relative to a vertical axis and/or moldboard roll or lean relative to a horizontal axis.

As can be appreciated, adjustment of one aspect of a motor grader operation can impact performance in other aspects. For example, when a motor grader is cutting material with the moldboard at an angle relative to the longitudinal axis of the machine, material is moved along the length of the moldboard and deposited to one side. In such an operation, the forward or leading edge of the moldboard is referred to as the "toe" and the trailing edge is referred to as the "heel". Depending on conditions of the earth or other material being moved, the topography, the angle of the moldboard and the like, the motor grader may be pulled away from an intended straight path toward the side of the moldboard toe, even if steering is adjusted for straight ahead operation. Absent compensatory adjustment in machine operation, the machine may deviate from the desired path of operation, which is referred to as draft. Side shifting the moldboard also creates draft. The more off center that the moldboard is, the greater the draft forces are.

A skilled operator has a variety of options available to adjust the motor grader operation to compensate for draft. For example, the operator can adjust the steering and/or change the drive system performance to apply greater pulling power in front of the toe of the moldboard, thereby overcoming draft. The operator also can adjust lean of the drive wheels in front of the moldboard. It is desirable to make the adjustments before the material pass begins; however, an inexperienced operator may not recognize before the pass is begun what adjustments are required nor the severity of the adjustments required to overcome draft. As a pass is made with the motor grader, even greater skill is required to detect changing conditions affecting draft, select an appropriate corrective measure or measures and enact the corrective measure or measures while continuing to observe machine operation and assess other changing operating conditions. Skilled operation of a motor grader involves initial setup, constant observation and assessment, and readjustment as necessary to achieve the desired result in the least amount of time.

Even a skilled motor grader operator can have difficulties in rapidly changing conditions. A less skilled operator can have difficulty achieving the desired result even in less challenging conditions due to the complex interactions of possible adjustments. Identifying the proper adjustment or adjustments and performing the adjustment or adjustments in a timely fashion can be difficult even for skilled motor grader operators.

What is needed in the art is a system for rapidly identifying and carrying out needed adjustments to compensate for motor grader draft during operation even in rapidly changing conditions.

SUMMARY OF THE INVENTION

The present invention provides sensors and controls to adjust a motor grader to compensate for anticipated draft based on moldboard adjustment and/or to overcome draft as it is experienced.

The invention in one form is directed to a ground engaging vehicle with a machine frame having front and rear wheels connected thereto, a wheel lean control system for tilting a set of the wheels, a moldboard adjustably connected to the frame for engaging ground lying material, a sensor system for determining an angle to which the moldboard has been adjusted; and an electronic controller controllably coupled to the wheel lean system and the sensor system. The electronic controller is configured for determining a required adjustment of the wheel lean control system necessary to counteract draft forces resulting from the angle to which the moldboard is adjusted, and for issuing commands to the wheel lean control system to make any necessary adjustments of the wheel lean control system.

The invention in another form is directed to a control system for a motor grader with a moldboard adjustably connected to the motor grader and a set of wheels adjustably tiltable from vertical. The control system includes a first sensor system issuing a signal indicative of an angle to which the moldboard is adjusted, a wheel lean control system for adjustably controlling the lean of the wheels and including a second sensor system issuing a signal indicative of the wheel lean, and an electronic controller coupled to the first and second sensor systems and to the wheel lean control system. The electronic controller is configured for receiving the signal from the first sensor system, calculating a required wheel lean angle to counteract draft forces from operating the motor grader at the angle to which the moldboard is adjusted, comparing the calculated wheel lean angle to the actual wheel lean angle from the second sensor system; and issuing a command to the wheel lean control system for making an adjustment of wheel lean angle in response to a difference determined in the comparing step.

An advantage of the present invention is that the effects of anticipated draft can be compensated for automatically, allowing the operator of a motor grader to focus attention on other tasks.

Another advantage is motor grader performance can be optimized.

Yet another advantage is that tire performance can be optimized, thereby enhancing tire life.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
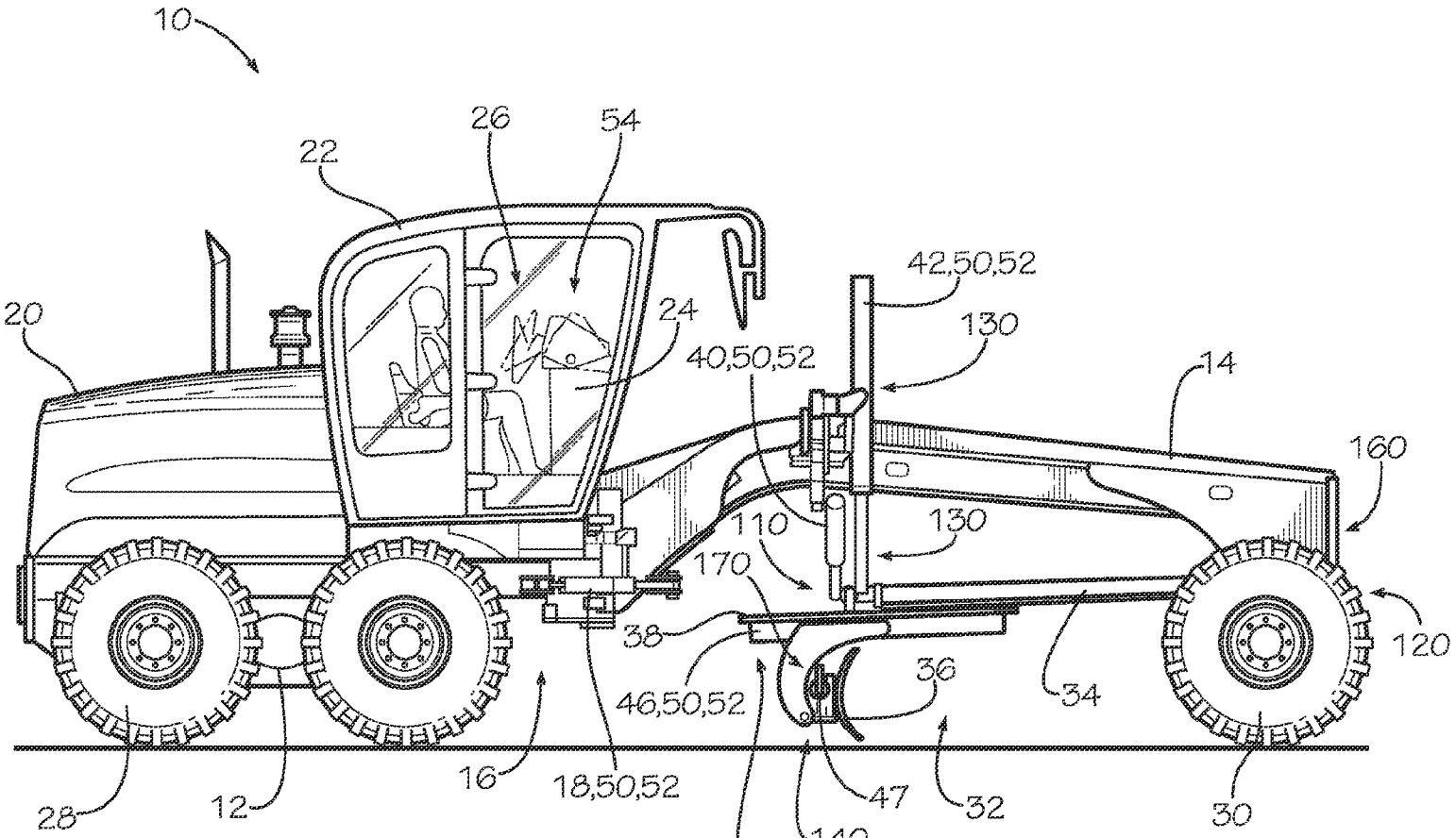
FIG. 1 is a side elevational view of a motor grader with a draft control system.
Figure 2:
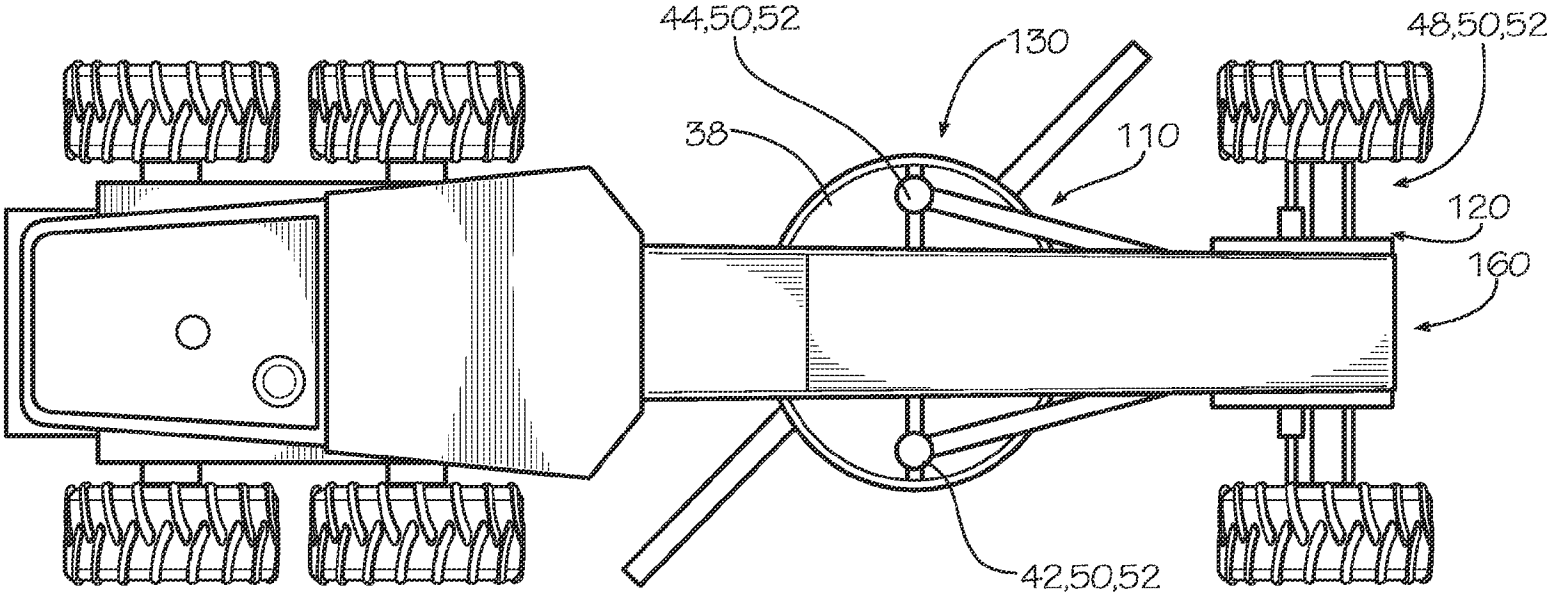
FIG. 2 is a top plan view of the motor grader.
Figure 3:
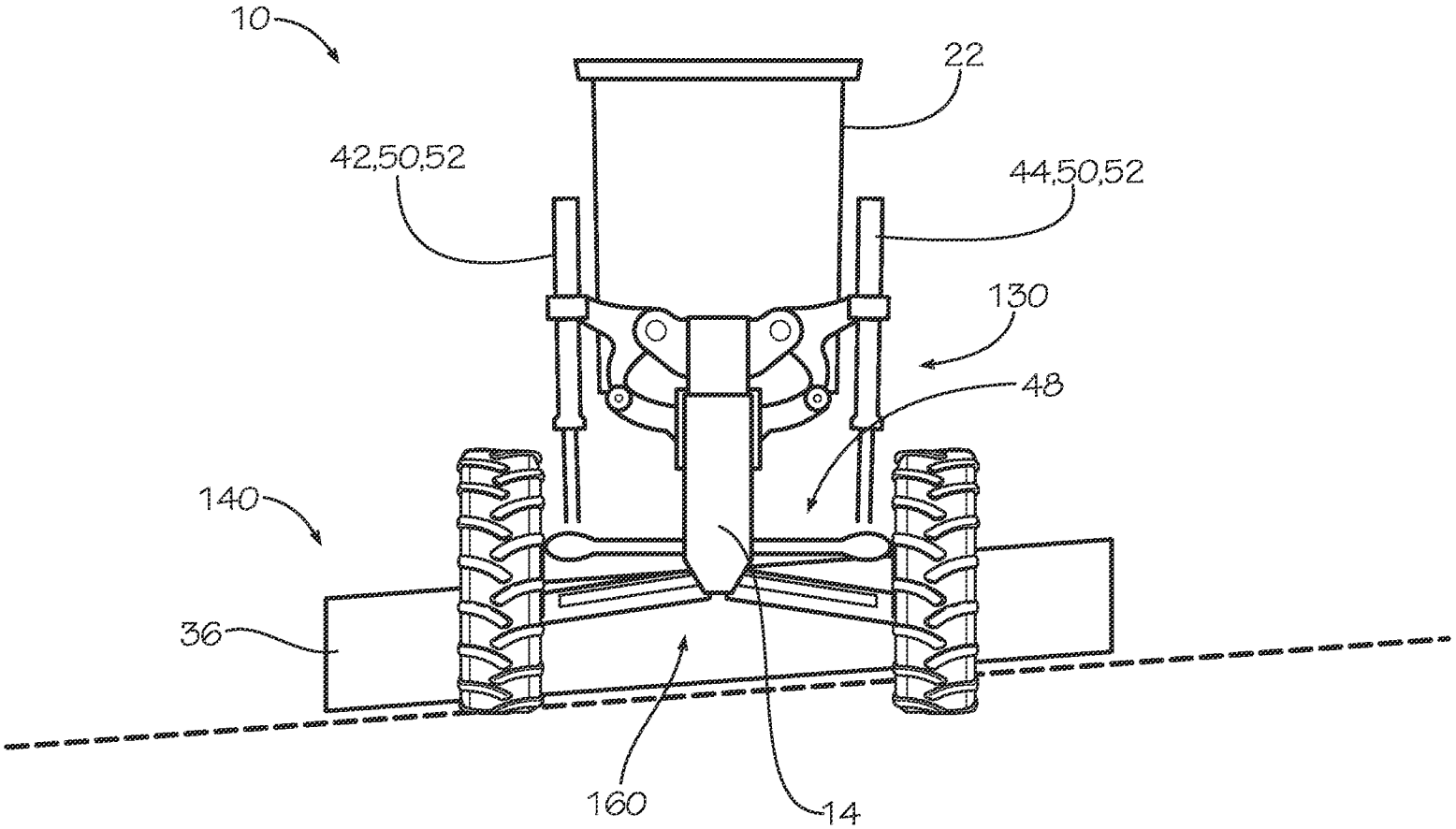
FIG. 3 is a front elevational view of the motor grader.
Figure 4:
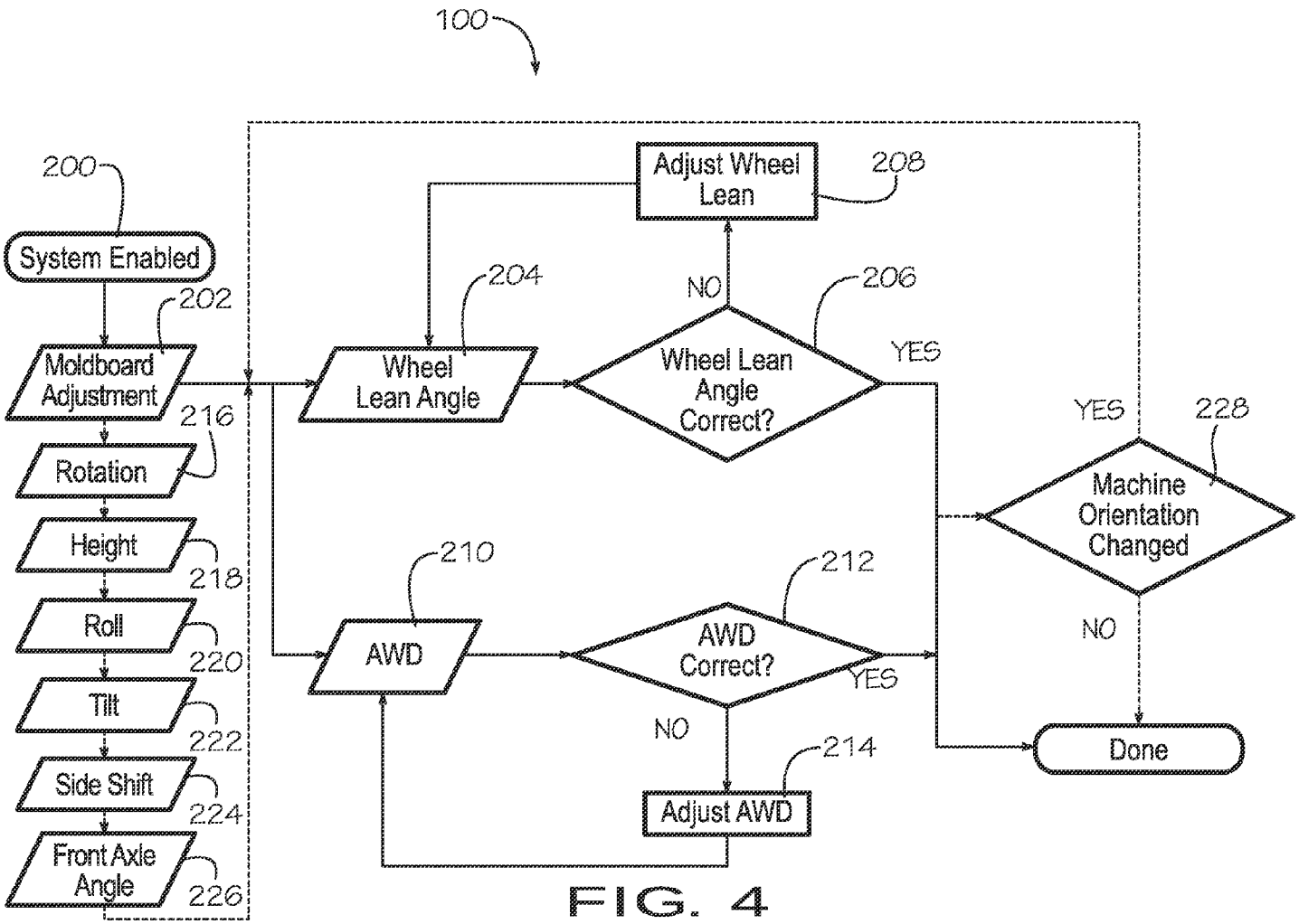
FIG. 4 is a flow chart of a method for operating the system.

Referring now to the drawings, and more particularly to FIGS. 1, 2 and 3 there is shown a motor grader 10 having an automated draft control system 100 (FIG. 4). Motor grader 10 has an articulating frame including a rear frame portion 12 and a front frame portion 14 pivotally connected to one another about an articulating joint 16. Accordingly, rear frame portion 12 and front frame portion 14 can be arranged in a straight line alignment, or can be arranged at various angular relationships to the left and to the right, pivoted about a vertical axis through articulating joint 16. One or more articulating adjustment cylinder 18 is provided for adjusting articulation, with front frame 14 positioned toward the left or to the right with respect to rear frame 12. Those skilled in the art will readily understand the construction and operation of a motor grader 10 having an articulating joint 16 between a rear frame portion 12 and a front frame portion 14.

Rear frame portion 12 includes an engine 20, which may be a diesel engine 20, and an operator cab 22. An operator console 24 and a variety of operator controls 26 are provided in operator cab 22. Rear frame portion 12 is supported by a tandem set of driven, ground engaging rear wheels 28.

Front frame portion 14 includes steerable front wheels 30 that can be leaned or tilted both left and right from a true vertical position. Front wheels 30 are driven in an all-wheel drive (AWD) motor grader. A moldboard assembly 32 is connected to front frame portion 14 by a drawbar 34. When motor grader 10 is operated to perform a grading function, loads created against moldboard assembly 32 are transmitted through drawbar 34 to front frame portion 14.

It should be understood that the general description and depiction of motor grader 10 is merely exemplary, and may differ from one machine to another. For example, the operator cab, operator console and operator controls can be positioned on the front frame in some motor grader designs. The automated moldboard draft control system and method described herein can work on various motor graders and other ground contacting equipment.

Moldboard assembly 32 includes a moldboard 36 below a plate gear 38 operated by a center shift cylinder 40 for controlling the angular orientation of moldboard 36 relative to front frame portion 14. Lift cylinders 42, 44 operatively connected to moldboard 36 to the left and to the right of front frame portion 14 are provided for lifting moldboard 36. Lift cylinders 42, 44 are independently operable and controllable so that moldboard 36 can be lifted and held at a level orientation or with either side held higher or lower than the other side so that the bottom or cutting edge of moldboard 36 is at an angle to horizontal. A tilt cylinder 46 adjusts the relative position of the top edge of moldboard 36 with respect to the bottom edge of moldboard 36 so that moldboard 36 can be tilted forward or backward. A side shift cylinder 47 adjusts moldboard 36 laterally toward either side from the centerline of front frame portion 14, to move the windrow of material forming at the heel end of the moldboard away from the travel path of rear wheels 28, and/or to reach material outside the intended drive path.

Front wheels 30 are provided with a wheel lean control system 48 for leaning or tilting the front wheels either to the left or to the right of vertical. Wheel lean can be used to counteract draft forces operating against motor grader 10 traveling in the desired direction.

The various operating and control cylinders described herein should be understood to include appropriate electrohydraulic valves 50 and position sensors 52 for operation, control and feedback. Accordingly, each of articulating adjustment cylinder 18, lift cylinders 42 and 44, tilt cylinder 46 and side shift cylinder 47 includes therein an appropriate electrohydraulic valve or valves 50 and a suitable position sensor 52. So also, wheel lean control system 48 includes actuators, electrohydraulic valves 50 and position sensors 52 for operating, control and feedback relative to wheel lean or tilt. Each of the aforedescribed cylinders and valves and sensors is operationally connected to operator console 24 and operator controls 26. Operator console 24 includes an electronic controller 54 for receiving and processing information from sensors 52 and for issuing control commands to electrohydraulic valves 50.

Position sensors 52 can be of any suitable type for the location and application in which it is used. For example, the sensors can be such as to determine linear actuation and/or rotational movement of any of the hydraulic cylinders. The electrohydraulic valves 50 may be of any suitable type to receive an electrical signal to control the flow of fluid for operating a cylinder. A feedback system may be used. Electrohydraulic valves 50 and position sensors 52 can be integral with the cylinders on which they are used or can be independent units.

An automated moldboard draft control system 100 can process information from one or more sensor, valve or feedback source and issue control commands for adjustment of motor grader 10. More specifically, a rotation sensor system 110 mounted on the hydraulic swivel provides moldboard angle information. Rotation sensor system 110 can include a rotary potentiometer or Hall Effect sensor connected to electronic controller 54, essentially measuring rotation on plate gear 30, andmay be associated with center shift cylinder 40. A wheel lean sensor system 120 associated with wheel lean control system 48 can include, for example, a rotary potentiometer, Hall Effect sensor, tilt sensor or inclinometer or a linear inductive sensor mounted at the pivot point or in the driving cylinder to provide information regarding wheel lean angle to electronic controller 54. A moldboard height sensor system 130 can be mounted on or in lift cylinders 42, 44 to provide information regarding moldboard height. Again, a linear inductive sensor, rotary potentiometer or Hall Effect sensor may be suitable for providing information to electronic controller 54. A moldboard roll sensor system 140 can be mounted directly to the moldboard to provide fore and aft roll information of the moldboard. A tilt sensor, or gyroscope may be used to provide moldboard roll information to electronic controller 54. Moldboard roll system 140 also can include sensors associated with the operation of tilt cylinder 46. A moldboard angle sensor system 150 can be mounted to the drawbar circle or center shift cylinder 40 or plate gear 38 to provide left to right angle moldboard position information. A tilt sensor or gyroscope can be used to provide information to electronic controller 54. Similar information could be obtained and provided to electronic controller 54 if separate sensors are provided in lift cylinders 42, 44 of moldboard height sensor system 130, with the differences between the two being indicative of moldboard angle. A front axle angle sensor system 160 can be mounted directly to the oscillating front axle and provide information regarding the angle of the front axle. Again, a tilt sensor or gyroscope can be used to provide information to electronic controller 54. A side shift sensor system 170 can be mounted on or associated with side shift cylinder 47. For example, a linear inductive sensor in side shift cylinder 47 can provide information to electronic controller 54 regarding side shift positioning of moldboard 36.

Electronic controller 54 is provided with historical data regarding various system settings necessary to avoid draft for given orientations of moldboard 36. The historical data can be data learned from previous operations of motor grader 10 at the same or other job sites. Alternatively or additionally the historical data may be calculated data. The historical data is used to establish the necessary wheel lean for a selected moldboard adjustment to overcome draft forces. In some uses of automated moldboard draft control system 100 control of the AWD system is used in conjunction with wheel lean adjustment.

Referring now to FIG. 4, which illustrates in block diagram form a method for operating the system hereof, an operator activates or enables the automated moldboard draft control system 100 in a step 200 via manipulation of a switch associated with operator console 24 and electronic controller 54 thereof. It should be recognized that switches referred to herein can be on screen switches of the touch-screen variety. Upon activating the system, in a subsequent step 202, the adjustment of moldboard 36 is obtained from information received regarding various factors, which may include changes in moldboard adjustment made by the operator with automated moldboard draft control system activated, and a wheel lean angle sufficient to negate draft forces is determined. In a step 204 the existing wheel lean is determined with information obtained from wheel lean sensor system 120. The existing wheel lean is compared to the required wheel lean in a step 206 and wheel lean is adjusted, if necessary, in a step 208. Accordingly, automatic adjustments are made to wheel lean control system 48 to counteract the system expected draft forces. In addition to or in place of wheel lean adjustments, automated moldboard draft control system 100 can also determine if AWD is active in a step 210, compare for correctness in a step 212 and make adjustments to the AWD, if necessary, in a step 214. Adjustment of AWD can be handled in place of wheel lean adjustments or can be made in addition to wheel lean adjustments.

Moldboard adjustment performed in step 202 can involve one or several changes to the moldboard orientation. The adjustment may include changes to and subsequent feedback information regarding moldboard rotation angle 216 from rotation sensor system 110, moldboard height 218 from moldboard height sensor system 130, moldboard roll 220 from moldboard roll sensor system 140, moldboard tilt 222 from moldboard angle sensor 150 and/or moldboard side shift 224 from side shift sensor system 170. Axle orientation 226 can be obtained from front axle angle sensor system regarding side hill or other machine orientation information that can impact the generation of draft forces.

After final adjustments are made and operation has begun, additional calculations can be made in a step 226 to determine actual machine orientation and whether it has changed, thereby indicating a response to draft forces. Step 226 requires the use of accelerometers, gyroscopes or other accurate position determining sensors. If a change in orientation is determined, wheel lean and/or AWD operation can be re-adjusted.

In other uses of automated moldboard draft control system, accelerometers, gyroscopes and the like at the front of motor grader 10 can sense actual draft as it occurs. In these instances, if the calculated adjustment is inadequate, actual draft will be detected quickly and further adjustments can be made to achieve straight-line operation. Manual override also can be provided so that an operator can make temporary adjustments necessary to avoid an object or otherwise prepare for an upcoming condition or situation.

The automated moldboard draft control system shown and described herein can optimize performance under difficult and/or unusual situations. For example, in hillside grading draft forces are different than grading on level ground. With the present system, wheel lean can be adjusted in response to front axle orientation as well as moldboard orientation, providing better control and stability in hillside grading. Further, when cutting a high bank, with the moldboard in a more vertical position, draft forces are different than on more level terrain. Sensing and considering blade angle can optimize performance in these situations as well.

An automated system can provide better performance, especially with inexperienced operators. The grader will be programmed to orient the wheels and adjust the AWD to be at the highest performance levels based on historical data. Having the wheels at the proper lean angle can prolong tire life and prevent damage. By automating some of the operating variables, the system allows operators of all skill levels to concentrate on moving the materials without distractions from continuous changes to the driving system.

Still further variations can be made. For example, required wheel lean can be calculated using information regarding engine or transmission torque levels and/or wheel slip. These would detect actual draft occurring, so would be responsive rather than preventative.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A ground engaging vehicle, comprising:

a machine frame having front and rear wheels connected thereto;

a variable and controllable vehicle drive system;

a wheel lean control system for tilting a set of the wheels;

a moldboard adjustably connected to the frame for engaging ground lying material;

a rotation sensor system for determining a rotation angle to which the moldboard has been adjusted; and an electronic controller controllably coupled to said wheel lean control system, said rotation sensor system, and said variable and controllable drive system, said electronic controller configured for determining a required adjustment of said variable and controllable drive system for said wheels and said wheel lean control system in response to draft forces resulting from the rotation angle of said moldboard, and for issuing commands to said wheel lean control system and said variable and controllable drive system to make adjustments in response to changes in said draft forces.

2. The ground engaging vehicle according to claim 1, further including a moldboard height sensor system communicating with said electronic controller and supplying a signal to said electronic controller indicative of a moldboard height adjustment.

3. The ground engaging vehicle according to claim 1, further including a moldboard roll sensor system communicating with said electronic controller and supplying a signal to said electronic controller indicative of a moldboard roll position.

4. The ground engaging vehicle according to claim 1, further including a front axle angle sensor system communicating with said electronic controller and supplying a signal to said electronic controller indicative of the angle of a front axle.

5. The ground engaging vehicle according to claim 1, including a moldboard angle sensor system communicating with said electronic controller and supplying a signal to said electronic controller indicative of a moldboard tilt angle.

6. The ground engaging vehicle according to claim 1, including a vehicle position sensor communicating with said electronic controller and supplying a signal to said electronic controller indicative of changes in a path being traversed by the vehicle.

7. The ground engaging vehicle according to claim 1, including a moldboard angle sensor system communicating with said electronic controller and supplying a signal to said electronic controller indicative of a moldboard tilt angle.

8. A control system for a motor grader with a moldboard adjustably connected to the motor grader and a set of wheels adjustably tiltable from vertical, the control system comprising:

a first sensor system issuing at least one signal indicative of positional information of the moldboard, wherein the positional information includes a rotation angle of the mold board and at least one of a mold board roll position, a mold board tilt angle, a mold board height;

a wheel lean control system for adjustably controlling the lean of the wheels and including a second sensor system issuing a signal indicative of the wheel lean;

an electronic controller coupled to said first and second sensor systems and to said wheel lean control system and configured for;

receiving the at least one signal from the first sensor system;

determining a required wheel lean angle to counteract draft forces from operating the motor grader at the position to which the moldboard is adjusted;

comparing the determined wheel lean angle to the actual wheel lean angle from the second sensor system; and issuing a command to the wheel lean control system for making an adjustment of wheel lean angle in response to a difference ascertained in said comparing step.

9. The control system according to claim 8, further including a drive system capable of adjustment and said electronic controller being further configured for calculating a drive system performance in response to changes in said draft forces, and issuing a command to said drive system in response thereto.

10. The control system according to claim 8, wherein the first sensor system further comprises a moldboard height sensor communicating with said electronic controller and the positional information further comprises the moldboard height adjustment.

11. The control system according to claim 8, wherein the first sensor system further comprises a moldboard roll sensor communicating with said electronic controller and the positional information further comprises the moldboard roll.

12. The control system according to claim 8, further including a front axle angle sensor system communicating with said electronic controller and supplying a signal to said electronic controller indicative of the angle of a front axle.

13. The control system according to claim 8, wherein the first sensor system further comprises a moldboard angle sensor communicating with said electronic controller and the positional information further comprises the moldboard tilt angle.

14. The control system according to claim 8, wherein the first sensor system further comprises a moldboard height sensor communicating with said electronic controller and the positional information further comprises the moldboard height adjustment.

15. The control system according to claim 8, a moldboard roll sensor communicating with said electronic controller and the positional information further comprises the moldboard roll.

16. The control system according to claim 8, further including a front axle angle sensor communicating with said electronic controller and supplying a signal to said electronic controller indicative of the angle of a front axle.

17. The control system according to claim 8, further including a vehicle position sensor communicating with said electronic controller and supplying a signal to said electronic controller indicative of changes in a path being traversed by the motor grader.

* * * * *